United States Patent [19]

Dobson et al.

[11] 3,938,113

[45] Feb. 10, 1976

[54] DIFFERENTIAL CAPACITIVE POSITION ENCODER

[75] Inventors: Donald R. Dobson, Versailles; Robert A. Williams, Lexington, both of Ky.

[73] Assignee: International Business Machines Corporation, Armonk, N.Y.

[22] Filed: June 17, 1974

[21] Appl. No.: 480,088

[52] U.S. Cl. ..... 340/200; 101/93.04

[51] Int. Cl.[2] ..... G08C 19/10

[58] Field of Search ..... 340/200

[56] References Cited

UNITED STATES PATENTS

| | | | |
|---|---|---|---|
| 2,674,729 | 4/1954 | Carter | 340/200 |
| 3,219,920 | 11/1965 | Wall | 340/200 |
| 3,296,522 | 1/1967 | Wolfendale | 340/200 |
| 3,732,553 | 5/1973 | Hardway | 340/200 |

*Primary Examiner*—Thomas B. Habecker
*Attorney, Agent, or Firm*—D. Kendall Cooper

[57] ABSTRACT

Circuits and structures are arranged to serve as encoders, emitters, or switches by capacitive coupling.

4 Claims, 8 Drawing Figures

DIFFERENTIAL CAPACITIVE POSITION ENCODER

CROSS-REFERENCE

The following case is hereby incorporated by reference:

U.S. Pat. application Ser. No. 313,886, having J. W. Woods, et al as inventors, filed Dec. 11, 1972, and entitled "Ink Jet Printing Apparatus with Overrun of Printhead to Insure Better Visibility and Counter Control of Printing Locations."

BACKGROUND OF INVENTION, FIELD AND PRIOR ART

Typical of encoders in this area are those described in the following publications:

"Dual Plane Capacitive Coupling Encoder", authored by R. J. Flaherty, M. L. Sendelweck, and J. W. Woods, IBM Technical Disclosure Bulletin, Vol. 15, No. 4, Sept. 1972.

"Electrodynamic Velocity and Position Sensor and Emitter Wheel", authored by H. E. Naylor, III, and R. A. Williams, IBM Technical Disclosure Bulletin, Vol 16, No. 10, March 1974.

SUMMARY

The encoders according to the present invention make use of differential capacitive coupling. The structures comprise a transmitter and a receiver, each of which consists of conducting surfaces. The output of the circuits is the result of a difference between selected capacitive couplings from selected ones of the surfaces.

Possible applications for the differential capacitive position encoder include the following:

1. Linear position sensing of carrier position for printers.
2. Shaft position encoder, such as emitter wheel.
3. Capacitive switches for keyboard transmit block on all machines with keyboard transmit block.
4. Limit switch application, e.g., left margin sensor for printer.
5. Non-contacting static switches, e.g., pitch switch for printer.

One practical advantage in using a capacitive sensor for the above applications is that implementation is simplified. This is in contrast with the fabrication problems presently associated with optical or magnetic position sensing techniques and structures.

OBJECTS

The primary object of the present invention is to provide improved encoder, sensor, emitter, and switching capabilities based on capacitive coupling.

The foregoing and other objects, features, and advantages of the invention will be apparent from the following more particular description of various embodiments of the invention as illustrated in the accompanying drawings.

DETAILED DESCRIPTION

System Description

Figure 1:
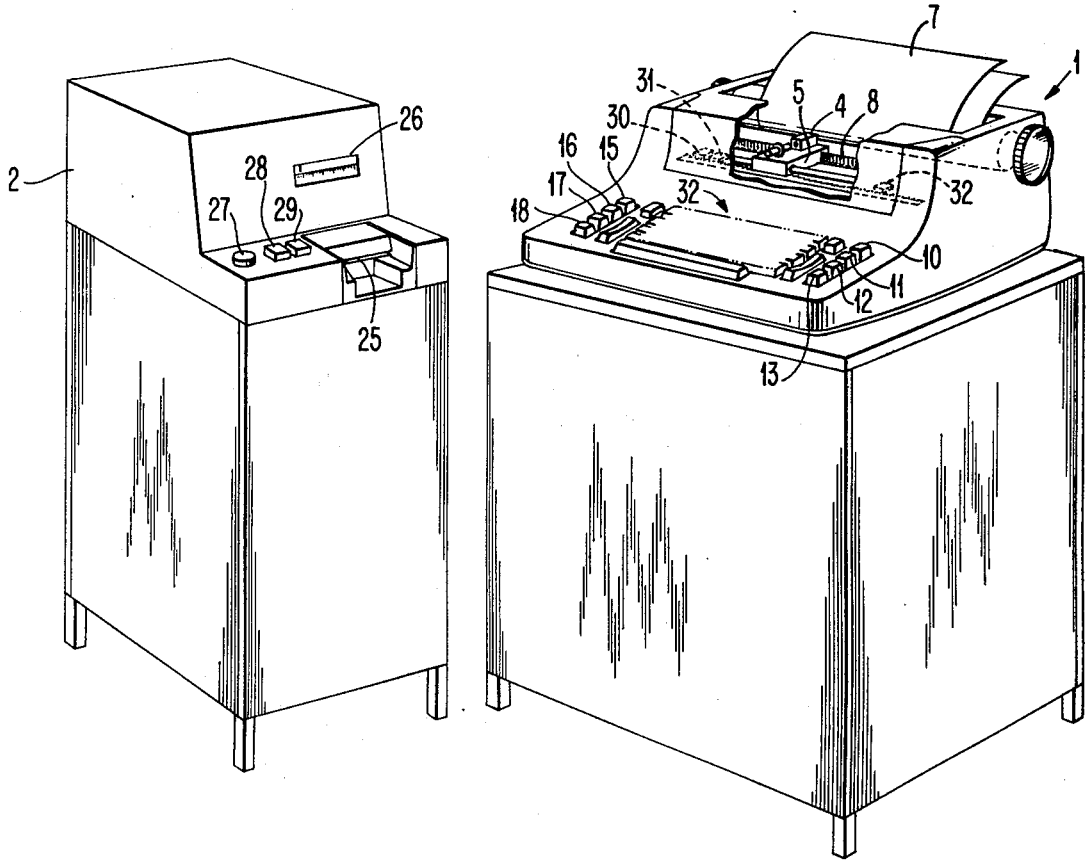
FIG. 1 illustrates an ink jet printer system in which a capacitive encoder of the present invention may be incorporated.

FIG. 1 illustrates an ink jet printing system incorporating a typewriter 1 with an associated magnetic card recording/reproducing unit 2. Card unit 2 is shown for convenience only and other kinds of storage units, recording/reproducing units, and the like, may be used. Typewriter 1 has the usual keyboard 32 which may be of the electrical type referred to in the Woods, et al case. Printer 1 incorporates an ink jet head assembly 4 mounted on a carrier 5 arranged for travelling movement from left to right (and conversely) adjacent a document 7 to be printed. Assembly 4 has an ink drop nozzle and an associated encoder 8 which may take one of the forms shown in greater detail in FIGS. 2–7. Printer 1 may be provided with various control buttons 10, 11, 12 and 13 for automatic, line, word, and character printing, respectively. Other keybuttons 15–18 concern mode selection, that is, record, playback, adjust, and skip, respectively.

Reference is made to various "Selectric" typewriter manuals referred to in the Woods, et al case for description of other keyboard facilities and other features of the printer. The magnetic card unit 2 has a load slot 25 and a track indicator 26. Also provided on unit 2 is a card eject button 27, a track stepdown button 28 and a track stepup button 29 for relocating the scanning transducer with respect to the various tracks on the card.

Printer 1 incorporates a left margin reed switch 30, a drop carrier return reed switch 31 and a right margin reed switch 32.

Encoder, Switch Description

Conventional capacitive position encoders operate by sensing the magnitude of the capacitance Ct between conducting surfaces as a function of the relative position of the surfaces. A typical implementation measures the amplitude of an alternating signal coupled through the capacitance Ct and gives a digital output based on whether the amplitude is greater than or less than a fixed reference. Encoders of this type suffer from the following drawbacks:

1. Factors other than position which affect capacitance (e.g., humidity) may produce errors.
2. Drift of the reference level may produce errors.
3. Resolution is limited by capacitive fringing effects.
4. The capacitive coupling may be influenced by movement in directions other than the direction desired.
5. Changes in the amplitude of the drive signal may produce position error.

Figure 2:
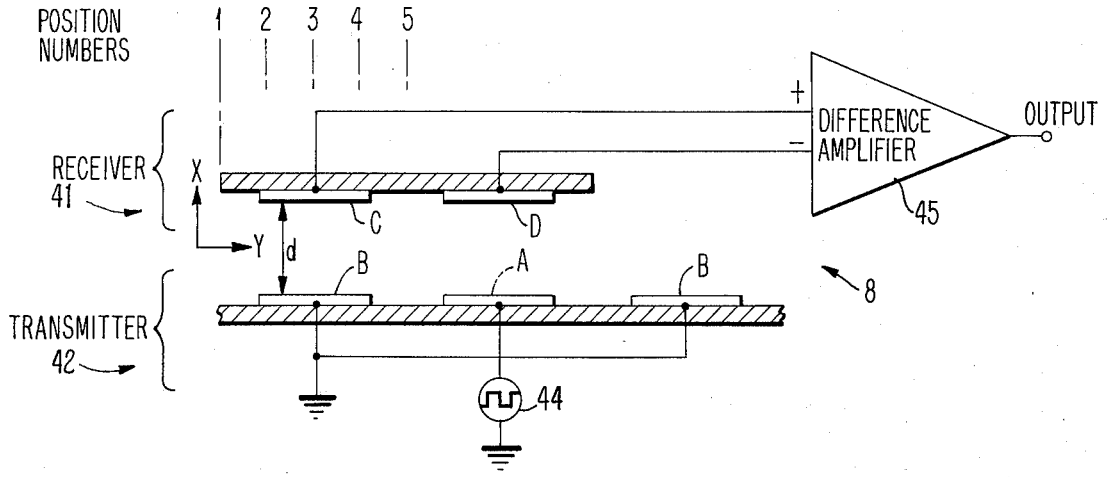
FIG. 2 is a basic illustration of a capacitive position encoder in accordance with the present invention.

A capacitive position encoder is described herein which minimizes the above drawbacks by employing differential capacitive coupling. FIG. 2 illustrates the basic principle. The encoder 8 comprises a "transmitter" 42 and a "receiver" 41. The "transmitter" consists of two conducting surfaces A and B with B grounded and A driven by an alternating signal from source 44. Receiver 41 consists of two conducting surfaces C and D which drive the two inputs of a difference amplifier 45. The output of difference amplifier 45 is determined by the difference between the capacitive coupling from A to C and the capacitive coupling from A to D. The grounded surface B reduces fringing of the electric field, thus improving the resolution of the encoder.

The "position numbers" 1–5 at the top left of FIG. 2 indicate several receiver 41 positions by showing the location of the "receiver" left edge for each position. For example, the receiver is shown in position 1, the leftmost of the numbered positions.

Figure 3:
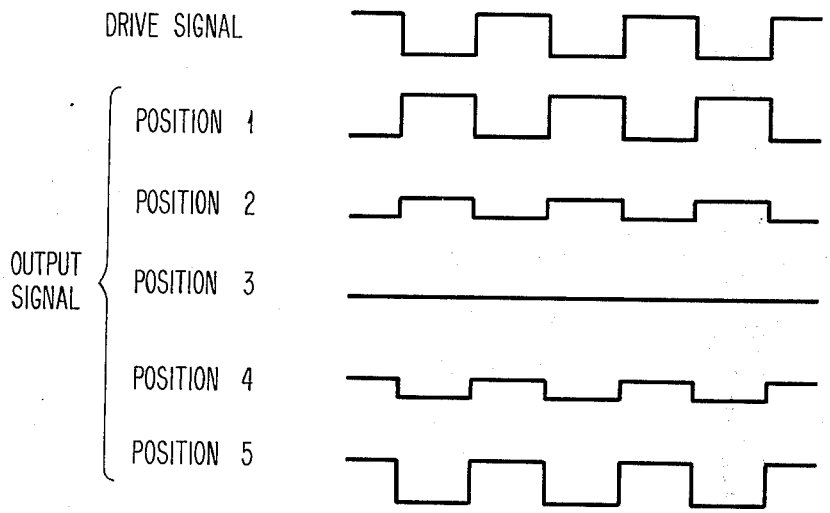
FIG. 3 illustrates various output signals from the encoder of FIG. 2.

FIG. 3 shows the output of the difference amplifier for each of the numbered positions (FIG. 1) of the receiver 41. When receiver 41 is to the right of position 3, the output is in phase with the drive signal. When it is to the left, the output is 180° out of phase with the drive signal. Thus, the position information is encoded as the phase of the output signal. This scheme has the following advantages:

1. If the conductor pattern is symmetrical, the location of the null point along the X-axis is independent of the amplitude of the drive signal, the separation distance *d* between transmitter and receiver, humidity, etc.

2. The null may be made very "sharp" by increasing the gain of the difference amplifier 45. Thus the achievable position resolution is limited mainly by the signal-to-noise ratio of amplifier 45.

3. The common mode rejection of difference amplifier 45 makes the encoder relatively insensitive to ambient electrical noise.

4. Coherent phase detection can be used, which further improves the noise immunity of the encoder.

Figure 4:
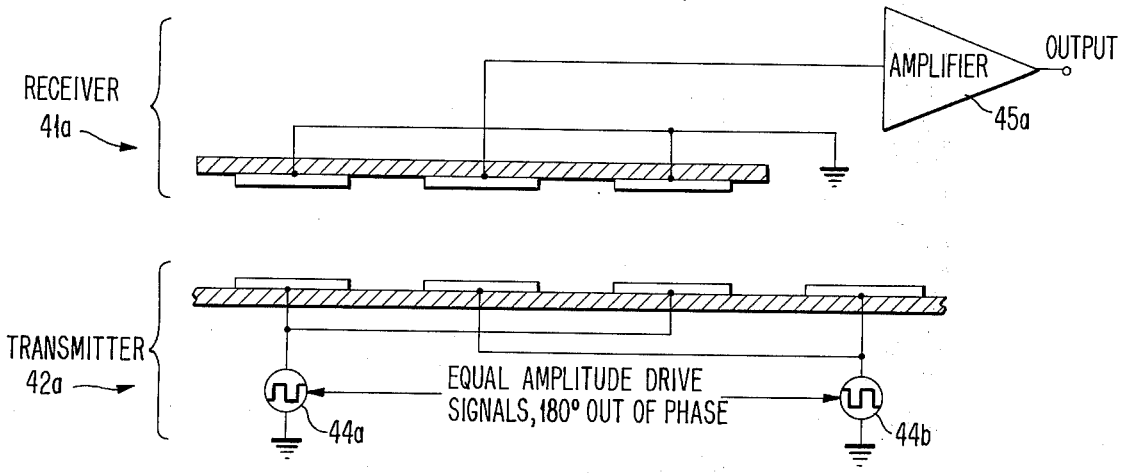
FIGS. 4 and 5 illustrate variations from the basic encoder of FIG. 2.
Figure 5:
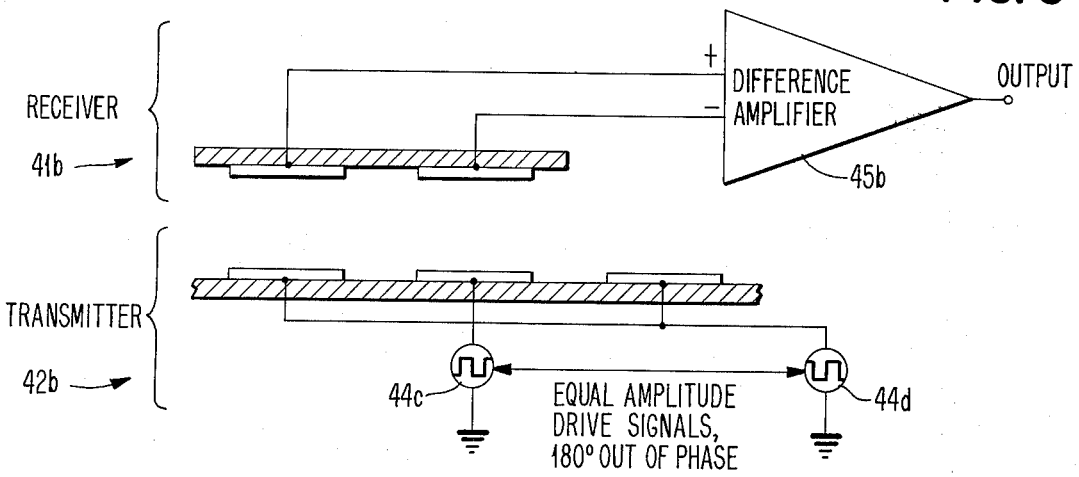

FIGS. 4 and 5 show two variations on the basic principle. Whereas the system in FIG. 2 employs single-ended drive and differential sensing, the arrangement in FIG. 4 employs differential drive and single-ended sensing and includes generators 44*a* and 44*b* and amplifier 45*a*. This approach has less noise immunity than the first, but it might entail cheaper circuitry. The arrangement in FIG. 5 employs both differential drive and differential sensing, and includes generators 44*c* and 44*d* and amplifier 45*b*.

Figure 6A:
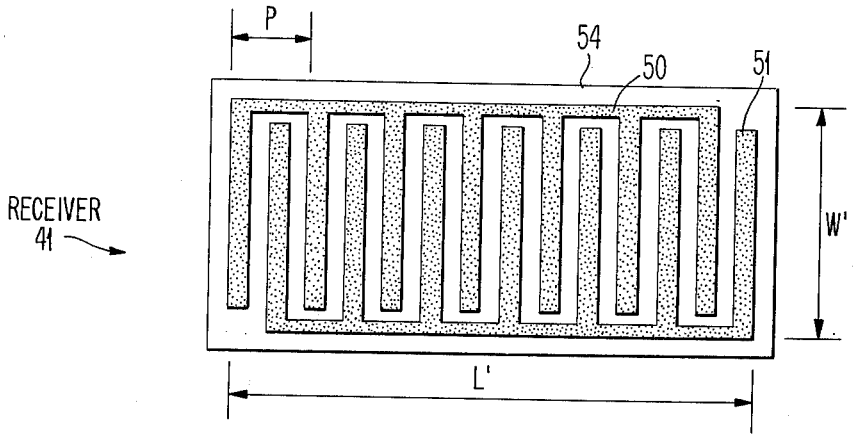
FIGS. 6*a*, 6*b*, and 7 illustrative design considerations.
Figure 6B:
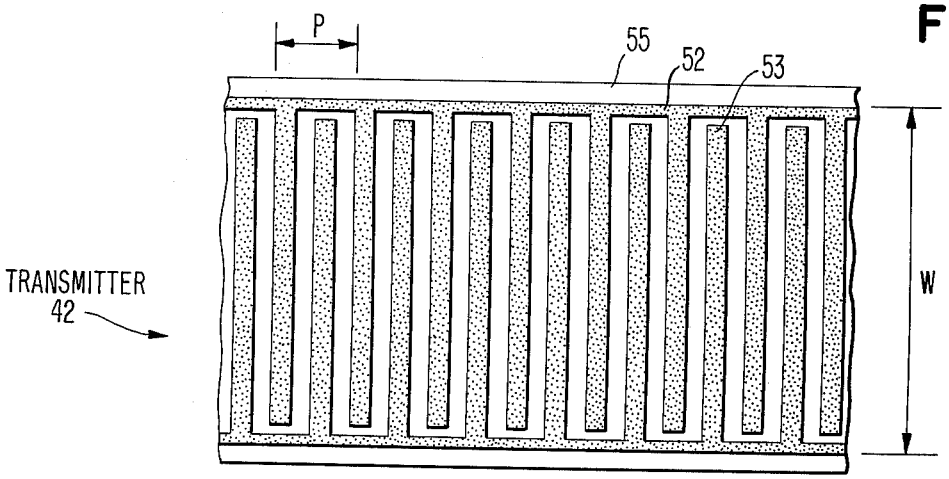
Figure 7:
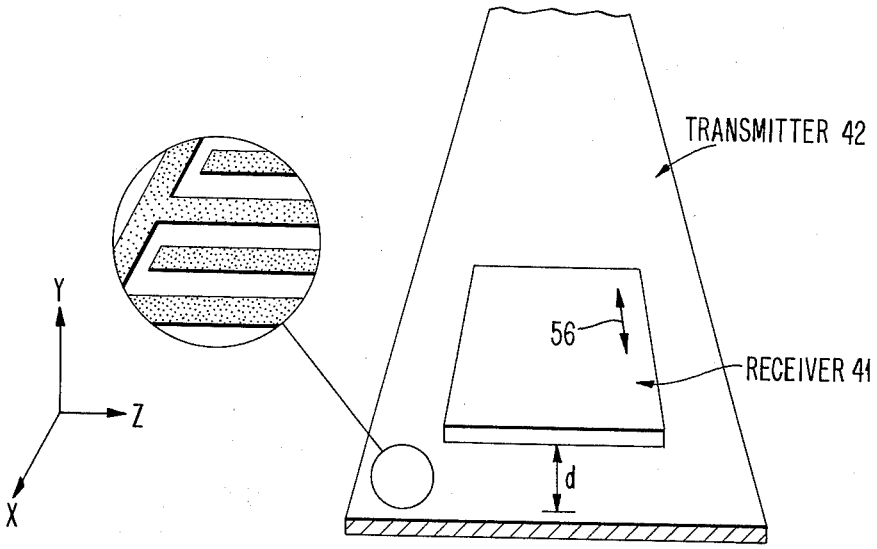

A practical design for a differential capacitive position transducer preferably consists of a number of conductors in an array, in order to achieve larger coupling capacitances. FIGS. 6a and 6b, and 7 show one easily fabricated design. Both "transmitter" and "receiver" consist of conductor patterns etched on printed circuit boards comprising copper patterns 50–53, on substrates 54 and 55, respectively. Note that each pattern 50–51 and 52–53 is completely symmetrical. The particular layout shown is designed for linear position encoding, but the approach is easily adaptable to angular position encoding. The following practical considerations deserve mention:

1. The dimension W′ of the receiver grating is intentionally made smaller than the dimension W of the transmitter grating so that the transducer is insensitive to undesired movement in the Z direction.

2. The ratio W′/P (W′=width of grating, P=period of grating) of the receiver grating should be made as small as practicable in order to minimize sensitivity to angular misalignment of the longitudinal axis of the receiver relative to the transmitter.

3. The ratio L′/P (L′=length of grating) should be made as large as practicable in order to minimize the sensitivity of the encoder to non-uniform separation between transmitter and receiver.

4. If wear is not a serious problem, the receiver could be lightly spring loaded against the transmitter for maximum coupling. A thin insulating coating (e.g., teflon) could be used to prevent direct contact.

FIG. 7 illustrates the relative placement of the receiver 41 and transmitter 42 shown in FIGS. 6*a* and 6*b*, respectively. Direction of movement is indicated by arrow 56, relative distance between receiver 41 and transmitter 42 by *d*. Transmitter 42 has the copper pattern top side up while receiver 41 has its copper pattern facing downwardly.

While the invention has been particularly shown and described with reference to several embodiments, it will be understood by those skilled in the art that various changes in form and detail may be made without departing from the spirit and scope of the invention.

What is claimed is:

1. A capacitive transducer, comprising:

a transmitter portion having a planar surface and incorporating a plurality of parallel conductive surfaces thereon arranged as a transmitter grating having length L and width W;

a receiver portion having a planar surface and incorporating a plurality of parallel conductive surfaces of period P thereon arranged as a receiver grating having length L′ comparable to length of said transmitter grating and width W′ that is substantially less than width W of said transmitter grating;

means mounting said transmitter and receiver portions for relative movement with said transmitter and receiver gratings a distance Y apart and in face-to-face complementary relationship in order to establish capacitive coupling between the respective conductive surfaces in said gratings, the relationship of said width dimensions W and W′ of said gratings insuring that said transducer is insensitive to undesired movement of said transmitter and receiver portions in a transverse Z direction, the ratio W′/P being relatively small in order to minimize angular misalignment of the longitudinal axis of said receiver portion relative to said transmitter portion, and the ratio L′/P being relatively large in order to minimize the sensitivity of said transducer to non-uniform separation between said transmitter and receiver portions;

moving means operable to relatively move said transmitter and receiver portions and their associated gratings with respect to one another;

at least one alternating signal generator coupled to alternate conductive surfaces of said transmitter grating;

an amplifier circuit having input and output connections and means interconnecting selected conducting surfaces of said receiver grating to the input connections of said amplifier circuit, said amplifier circuit thereby providing output signals indicative of both extent and direction of movement of said transmitter and receiver portions during relative movement.

2. A capacitive transducer as defined in claim 1, wherein the conductive surfaces in said transmitter grating are arranged in two groups A and B of alternate conductive surfaces and wherein the conductive surfaces in said receiver grating are arranged in two groups C and D of alternate conductive surfaces, and further comprising:

signal generating means interconnected with group A of the conductive surfaces in said transmitter grating;

means grounding group B of the conductive surfaces in said transmitter grating;

a difference amplifier having two inputs;

means relatively interconnecting each of the individual C and D groups of conducting surfaces in said receiver grating to one of said inputs of said difference amplifier; said amplifier thereby providing output signals representative of the differences in capacitive coupling between group A and group C and the capacitive coupling between group A and group D, said signals being indicative of the extent and direction of movement of said transmitter and receiver portions during relative movement.

3. A capacitive transducer as defined in claim 1, wherein the conductive surfaces in said transmitter grating are arranged in two groups A and B of alternate conductive surfaces and wherein the conductive surfaces in said receiver grating are arranged in two groups C and D of alternate conductive surfaces, and further comprising:

first signal generating means interconnected with group A of the conductive surfaces in said transmitter grating;

second signal generating means interconnected with group B of the conductive surfaces in said transmitter grating;

an amplifier having input and output connections;

means interconnecting group C of the conducting surfaces in said receiver grating to the input of said amplifier; and means interconnecting group D of the conducting surfaces in said receiver grating to ground, said amplifier thereby providing output signals representative of the capacitive coupling between the conductive surfaces of said transmitter and receiver gratings, said signals being indicative of the extent and direction of movement of said transmitter and receiver portions during relative movement.

4. A capacitive transducer as defined in claim 1, wherein the conductive surfaces in said transmitter grating are arranged in two groups A and B of alternate conductive surfaces and wherein the conductive surfaces in said receiver grating are arranged in two groups C and D of alternate conductive surfaces, and further comprising:

first signal generating means interconnected with group A of the conductive surfaces in said transmitter grating;

second signal generating means interconnected with group B of the conductive surfaces in said transmitter grating;

a difference amplifier having a pair of input connections and an output connection;

means respectively interconnecting each of the individual C and D groups of conducting surfaces in said receiver grating to one of said inputs of said difference amplifier, said amplifier thereby providing output signals representative of the differences in capacitive coupling between the conductive surfaces of said transmitter and receiver gratings, said signals being indicative of the extent and direction of movement of said trnsmitter and receiver portions during relative movement.

* * * * *